United States Patent [19]

Dozier

[11] 4,101,153

[45] Jul. 18, 1978

[54] QUICK OPENING LOCK ASSEMBLY FOR DOORS AND METHOD

[76] Inventor: Donald P. Dozier, 2301 Crystal Ave., Concord, Calif. 94520

[21] Appl. No.: 820,021

[22] Filed: Jul. 29, 1977

Related U.S. Application Data

[63] Continuation of Ser. No. 517,477, Oct. 24, 1974, abandoned.

[51] Int. Cl.[2] ..... E05C 15/02; E05C 1/14

[52] U.S. Cl. ..... 292/92; 70/92; 292/165; 292/185; 292/336.3

[58] Field of Search ..... 70/92; 292/34, 46, 92, 292/93, 165, 185, 222, 232, 336.3, 353; 74/56

[56] References Cited

U.S. PATENT DOCUMENTS

| | | | |
|---|---|---|---|
| 974,886 | 11/1910 | Hodgkinson | 292/93 |
| 1,056,937 | 3/1913 | Pratt | 292/92 |
| 1,621,174 | 3/1927 | Schlage | 292/353 |
| 2,729,486 | 1/1956 | Evans | 292/92 |
| 2,883,183 | 4/1959 | Finsternwalder et al. | 74/56 X |
| 2,928,690 | 3/1960 | Larson | 292/336.3 |
| 3,009,347 | 11/1961 | George | 70/448 X |
| 3,128,115 | 4/1964 | Patriquin et al. | 292/165 X |
| 3,177,024 | 4/1965 | Krook et al. | 292/353 |
| 3,374,684 | 3/1968 | Greven | 74/56 |
| 3,458,225 | 7/1969 | Brothers et al. | 70/92 X |
| 3,731,962 | 5/1973 | Enochian | 292/34 |
| 3,865,414 | 2/1975 | Schlage | 292/165 X |
| 3,869,159 | 4/1975 | Eads | 292/92 |

FOREIGN PATENT DOCUMENTS

| | | | |
|---|---|---|---|
| 3,902 of | 1913 | United Kingdom | 292/165 |

*Primary Examiner*—Thomas J. Holko
*Attorney, Agent, or Firm*—Phillips, Moore, Weissenberger, Lempio & Majestic

[57] ABSTRACT

A lock assembly is mounted on a door for opening the same upon depression of a handle pivotally mounted thereon. A spiralled cam is formed on a tubular adapter, detachably mounted on a rotary spindle of a lock assembly to replace a door knob. The handle engages the cam for retracting a latch normally extended into a striker plate for holding the door in a locked position on a door jamb, upon pivoting of the handle.

13 Claims, 6 Drawing Figures

QUICK OPENING LOCK ASSEMBLY FOR DOORS AND METHOD

CROSS-REFERENCE TO RELATED APPLICATION

This application is a Continuation of U.S Pat. application Ser. No. 517,477, filed on Oct. 24, 1974 by Donald P. Dozier and now abandoned.

BACKGROUND OF THE INVENTION

Conventional door lock assemblies normally comprise a knob which is rotated to retract a latch from a striker plate. In emergency situations, such as when a crowd of children attempt to leave a room en masse in the face of impending danger such as fire, it may prove difficult to rotate the knob a sufficient amount to open the door. The State of California, for example, has enacted laws requiring the use of panic hardware on at least one door to provide expeditious egress from a public room designed to accommodate forty or more people.

Attempts have been made to construct lock assemblies of the panic hardware type to expedite the unlatching thereof in emergency situations. However, such attempts have normally resulted in complex and expensive hardware which do not always provide the desired structural integrity and capability of operating efficiently over an extended period of time. In addition, it is highly desirable to convert a standard lock assembly with reliable panic hardware economically and expeditiously.

SUMMARY OF THIS INVENTION

An object of this invention is to provide a facile, economical, non-complex and highly reliable lock assembly for a door which can be opened expeditiously by merely degressing a handle means thereof.

The lock assembly further comprises a latch unit having a latch movably mounted therein for engagement with the striker plate secured to a door jamb. An adapter, adapted to replace a door knob, comprises a tubular sleeve slidably mounted on a rotary spindle and a spiralled cam formed on the sleeve. Means are provided for detachably mounting the sleeve on the spiral to prevent rotational and axial displacement therebetween. Motion transmitting means are mechanically interconnected between the latch and the spindle for retracting the latch to its unlocked position upon depression of the handle means, movably mounted adjacent to the adapter to engage the cam thereof directly.

In the preferred embodiment of this invention, the handle means is pivotally mounted on a housing adapted to be secured to the door. In carrying forth the method steps of this invention, the adapter replaces a conventional door knob and the housing is secured to the door without having to modify the same whereby conventional lock assemblies may be converted to panic hardware economically and expeditiously.

BRIEF DESCRIPTION OF THE DRAWINGS

Other objects of this invention will become apparent from the following description and accompanying drawings wherein.

DETAILED DESCRIPTION

Figure 1:
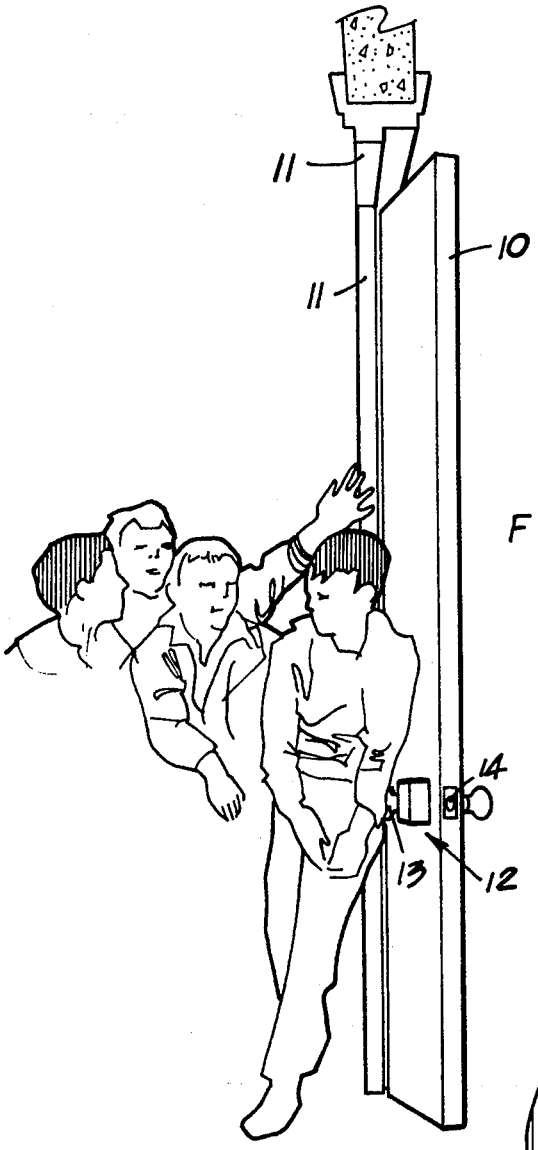
FIG. 1 illustrates a door having the quick opening lock assembly of this invention employed thereon.

FIG. 1 illustrates a door 10 hingedly mounted in a conventional manner on a door frame 11 and normally latched to a jamb thereof (not shown) by a lock assembly 12 of this invention. This figure further illustrates an emergency situation wherein a group of school children are able to open the door expeditiously by merely leaning against a horizontally disposed handle means 13 of the lock assembly to retract a latch 14 from a striker plate (not shown) secured to such jamb. During such an emergency situation, a child could panic and forget or be unable to rotate a knob of a conventional lock assembly due to the crowding of other children behind him.

Figure 2:
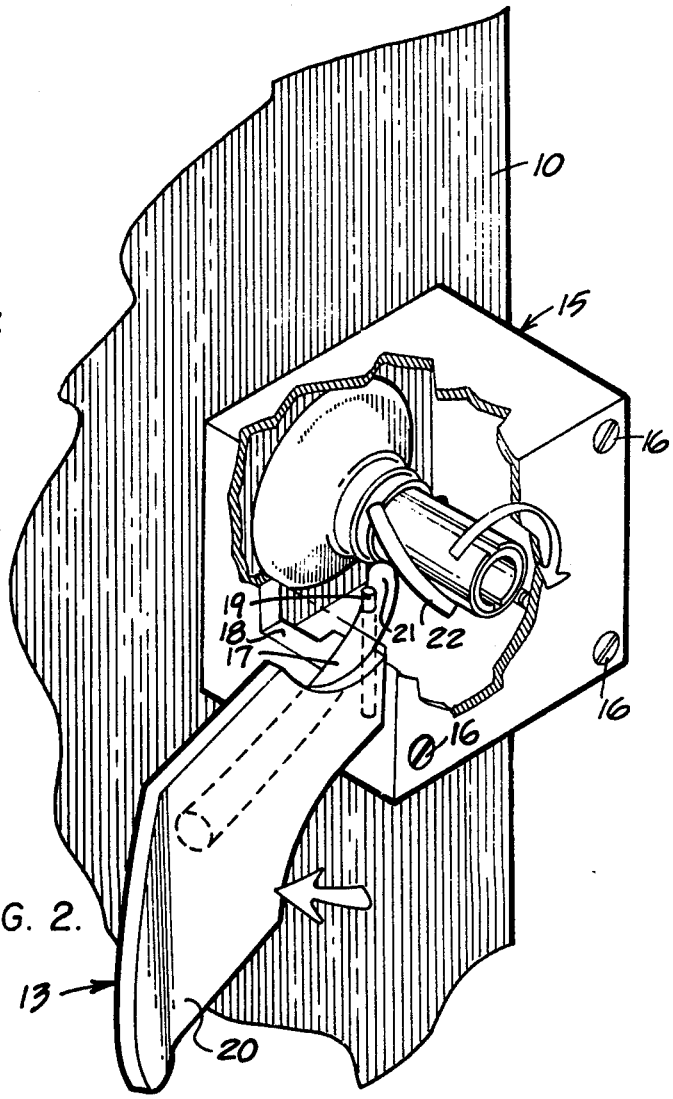
FIG. 2 is an enlarged isometric view of an adapter, handle and housing employed in the lock assembly.

Referring to FIG. 2, the quick opening lock assembly of this invention comprises a box-like housing 15, preferably composed of a solid brass material, secured to one side of the door 10 by four elongated wood screws 16. Handle means 13 comprises a bent metal stem 17 extending through an elongated aperture 18 formed through a sidewall of the housing and pivotally mounted thereon by a vertically disposed pivot pin 19. A flared member 20 is secured on an outer end of the stem to provide an enlarged area for door opening purposes whereas an inner end 21 of the stem engages a cam means 22 formed on an adapter 23. The adapter, rotatably mounted on the lock assembly, preferably constitutes a tubular or cylindrical sleeve, having a substantially constant wall thickness throughout the length thereof. The sleeve is slidably mounted on a spindle 24 (FIG. 3) and releasably locked thereon to rotate therewith.

Figure 4:
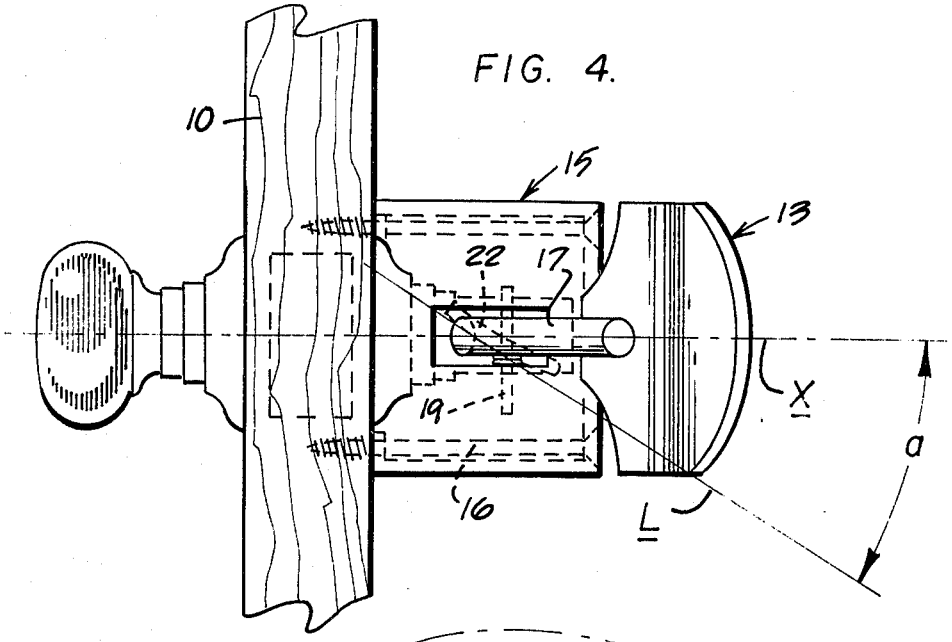
FIG. 4 is a side elevational view of the lock assembly mounted on a door.
Figure 5:
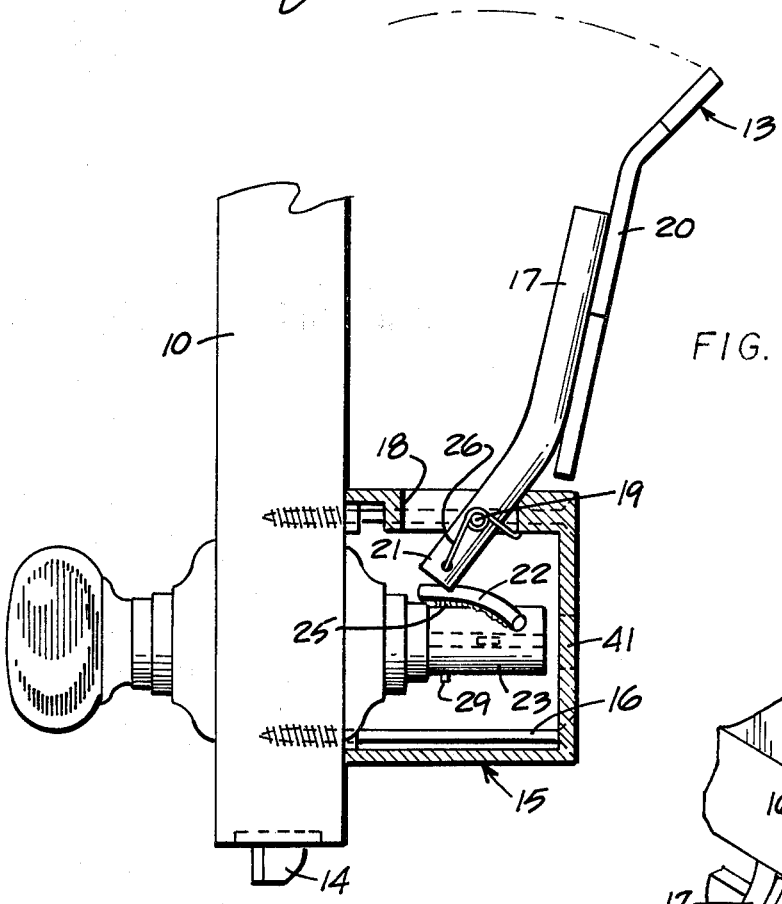
FIG. 5 is a partially sectioned view similar to FIG. 4, but in bottom plan.

Referring to FIGS. 4 and 5, the cam means preferably comprises a cylindrical rod which is suitably bent into a spiralled shape and brazed or otherwise suitably secured at 25 to the sleeve. The degree of spiral of the cam means on the adapter is substantially uniform throughout the length of the cam means and an imaginary line L, tangent relative to the cam means, is disposed at an angle a preferably selected from the approximate range of from 30° to 40° relative to a longitudinal and rotational axis X of the adapter (FIG. 4). A spring means, such as torsion spring 26 mounted on pin 19, is operatively interconnected between the stem and the housing to bias the handle outwardly away from the housing. Inner end 21 of stem 17 is thus automatically and normally positioned on an inner portion of cam means 22, when latch 14 is in its extended locked position, upon release of the handle means.

Figure 3:
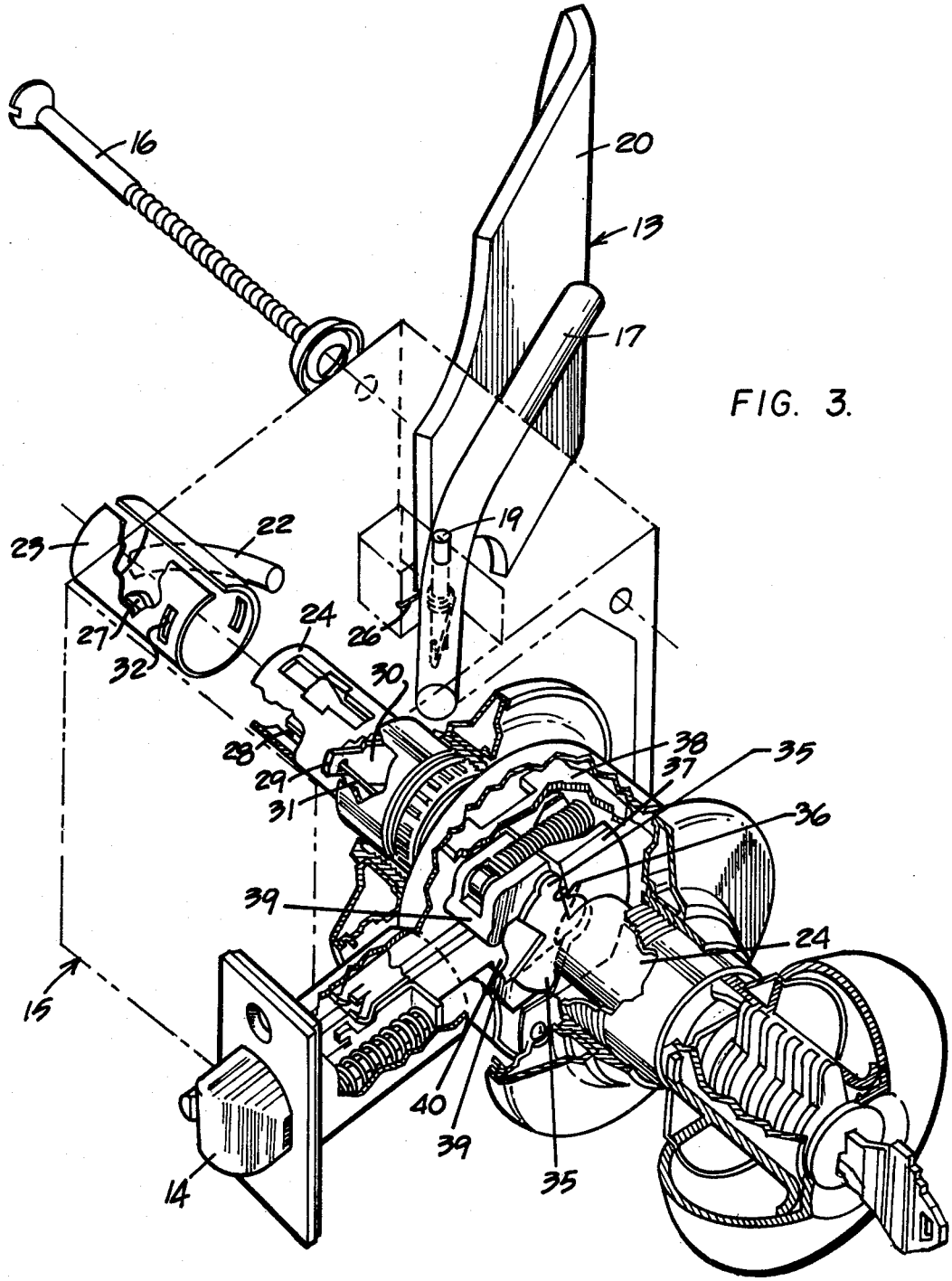
FIG. 3 is an enlarged, partially exploded and sectioned isometric view of the lock assembly.

Referring to FIG. 3, tubular spindle 24 constitutes a component of a conventional classroom lock, such as Model D70PD manufactured by Schlage Lock Company. In essence, such a conventional lock can be modified expeditiously by the removal of one door knob and the addition of applicant's kit, comprising adapter 23, handle 20 and housing 15, thereto. Spindle 24 comprises a rotary input component of a conventional motion transmitting means which converts such rotary motion of the spindle to a reciprocating motion of latch bolt 14.

Adapter sleeve 23 is slidably mounted on spindle 24 by engaging a lug 27 of the adapter with a slot 28 formed longitudinally through a sidewall of the spindle to prevent relative rotational movement therebetween. The adapter is locked against axial movement on the spindle by means of a lug 29 formed on a member 30 disposed transversely in the spindle. Such member is urged radially outwardly by a finger spring 31 to engage lug 29 with a mating aperture 32 formed through a sidewall of the adapter.

The conventional motion transmitting means essentially comprises a pair of cam lobes 35 formed on an inboard end of spindle 24 to engage cam surfaces 36 within a U-shaped slide 37. It should be noted that the pair of spindles 24, disposed on opposite sides of the slide to facilitate opening of a door from either side thereof, are substantially identical to construction. Rotation of the spindle will thus function to reciprocate the spring-biased slide within a stationary member 38. A pair of lugs 39 are formed on the end of the slide to engage enlarged end portions 40 of the latch unit to reciprocate latch bolt 14. Further detailed description of such a conventional lock may be found in Form MS52 published by Schlage Lock Company in 1971.

Figure 6:
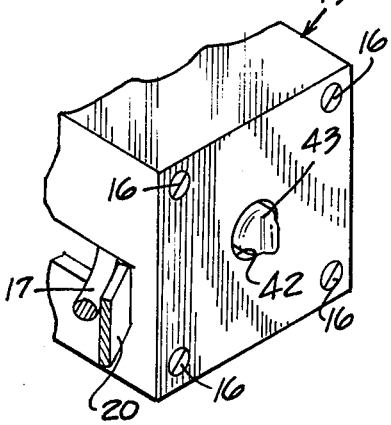
FIG. 6 is a reduced partial view of a housing for the lock assembly, further illustrating a conventional plunger unit projecting through an aperture defined by a knock-out plug of the housing.

In operation, depression of handle means 13 towards door 10 in FIG. 5 will pivot inner bearing end 21 thereof counterclockwise about pivot pin 19 to rotate cam 22 and adapter 23 (FIG. 2). Referring to FIG. 3, rotation of the adapter and spindle 24 will function to rotate a cam lobe 35 against a respective cam surface 36 to retract slide 37 to thus retract latch 14 to its unlocked position. Release of handle means 13 will permit the spring biased components of the lock assembly to return to their normal FIGS. 2–5 positions. It should be noted that housing 15 may have an annular knock-out plug 41 pre-formed thereon in axial alignment with adapter 23 to define a circular opening 42 accommodating plunger unit 43 of a conventional entrance lock or the like (FIG. 6).

I claim:

1. A lock assembly comprising a rotary tubular spindle, a latch unit including a latch movably mounted therein for movement between locked and unlocked positions, an adapter, adapted to replace a door knob, including a tubular sleeve slidably mounted on said spindle and cam means disposed in spiralled relationship on said sleeve, means detachably mounting said sleeve on said spindle for preventing both rotational and axial displacement of said sleeve relative to said spindle, motion transmitting means mechanically interconnected between said latch and said spindle for moving said latch to its unlocked position upon rotation of said adapter, handle means movably mounted adjacent to said adapter and operatively engaged directly with said cam means for rotating said adapter and said spindle upon movement of said handle means, and a housing enclosing said adapter and said spindle and wherein said handle means comprises a single stem extending through a sidewall of said housing and pivotally mounted thereon, an inner end of said stem engaging said cam means in substantial line and sliding bearing contact therewith, said means detachably mounting said sleeve on said spindle being independent of said housing and maintaining said sleeve in a fixed axial position relative to said spindle so that the inner end of said stem will be continuously and precisely maintained in bearing contact with said cam means upon pivoting of said handle means on said housing to move said latch between its locked and unlocked positions.

2. The lock assembly of claim 1 wherein said means for detachably mounting said sleeve on said spindle comprises a lug secured internally on said sleeve and slidably received within a longitudinal slot formed through a sidewall of said spindle for preventing rotational displacement of said sleeve relative to said spindle.

3. The lock assembly of claim 2 wherein said means for detachably mounting said sleeve on said spindle further comprises a lug mounted on said spindle and engaged within an aperture formed through a sidewall of said sleeve and means for biasing said lug into such engagement, said sleeve having a substantially uniform and constant wall thickness throughout the length thereof.

4. The lock assembly of claim 1 wherein the degree of spiral of said cam means of said adapter is substantially uniform throughout the length thereof and wherein an imaginary line tangent to said cam means is disposed at an angle within the approximate range of from 30° to 40° relative to a longitudinal and rotational axis of said adapter.

5. The lock assembly of claim 1 wherein said cam means comprises a bent rod of cylindrical cross section secured to said adapter.

6. The lock assembly of claim 1 wherein said handle means is horizontally disposed and further comprises a flared member secured to an outer end of said stem and disposed exteriorly of and on a side of said housing whereby horizontal pivoting of said handle means will rotate said adapter and said spindle.

7. The lock assembly of claim 1 further comprising spring means operatively interconnected between said stem and said housing for biasing said handle means outwardly away from said housing to automatically position the inner end of said stem on an inner portion of said cam means, when said latch is in its extended locked position, upon release of said handle means.

8. The lock assembly of claim 7 wherein said spring means constitutes a torsion spring mounted on a pivot pin pivotally mounting said handle means on said housing.

9. The lock assembly of claim 1 further comprising means defining an annular knock-out plug on a backside of said housing and in axial alignment with said adapter.

10. The lock assembly of claim 1 further comprising a door, said housing releasably attached to said door.

11. A method for converting a lock assembly to panic hardware, said lock assembly mounted on a door and comprising a latch unit movable between normally locked and unlocked positions relative to a door frame having said door hingedly mounted thereon, a rotary spindle, a knob detachably mounted on said spindle and motion transmitting means mechanically and interconnected between said latch unit and said spindle for moving said latch unit to its unlocked position upon rotation of said adapter, said method comprising the steps of detaching said knob from said spindle, attaching a tubular adapter sleeve, having a spiralled cam secured thereto, directly to said spindle to prevent both rotational and axial movement therebetween, securing a housing to said door to enclose said spindle, and said sleeve therein and simultaneously spacing an outer wall of said housing axially relative to an outer end of said sleeve to prevent contact therebetween;

pivotally mounting a handle on said housing and adjacent to said sleeve to engage an inner end of a single stem of said handle directly with said cam in bearing contact therewith whereby pivoting of said handle will rotate said sleeve and said spindle to move said latch unit to its unlocked position.

12. The method of claim 11 wherein said mounting step comprises pivotally mounting said handle in horizontally disposed relationship on a side of said housing.

13. The method of claim 11 further comprising the step of continuously biasing the inner end of said handle into bearing contact with said cam.

* * * * *

UNITED STATES PATENT OFFICE

CERTIFICATE OF CORRECTION

Patent No. 4,101,153 Dated July 18, 1978

Inventor(s) Donald P. Dozier

It is certified that error appears in the above-identified patent and that said Letters Patent are hereby corrected as shown below:

Col. 1, line 38, change "degressing" to --depressing--.

Col. 4, line 62 (claim 11), delete "and".

Col. 4, line 65 (claim 11), change "adapter" to --knob--.

Signed and Sealed this

*Ninth* Day of *January 1979*

[SEAL]

*Attest:*

RUTH C. MASON
*Attesting Officer*

DONALD W. BANNER
*Commissioner of Patents and Trademarks*